US008373496B2

(12) United States Patent
Cusinato

(10) Patent No.: US 8,373,496 B2
(45) Date of Patent: Feb. 12, 2013

(54) TEMPERATURE COMPENSATED CURRENT SOURCE

(75) Inventor: Paolo Giovanni Cusinato, Villeneuve-Loubet (FR)

(73) Assignee: Texas Instruments Incorporated, Dallas, TX (US)

( * ) Notice: Subject to any disclaimer, the term of this patent is extended or adjusted under 35 U.S.C. 154(b) by 131 days.

(21) Appl. No.: 12/847,615

(22) Filed: Jul. 30, 2010

(65) Prior Publication Data

US 2012/0007659 A1 Jan. 12, 2012

(30) Foreign Application Priority Data

Jul. 9, 2010 (EP) ..... 10290378

(51) Int. Cl.
*G05F 3/02* (2006.01)

(52) U.S. Cl. ..... 327/513; 327/538; 327/543; 323/312; 323/315

(58) Field of Classification Search ..... 327/512, 327/513, 530, 538–543; 323/311, 312, 315–317
See application file for complete search history.

(56) References Cited

U.S. PATENT DOCUMENTS 6,191,660 B1 * 2/2001 Mar et al. ..... 331/111
6,222,470 B1 * 4/2001 Schuelke ..... 341/119
6,437,622 B1 8/2002 Tinsley et al.
6,556,155 B1 4/2003 Wiles, Jr.
6,911,861 B2 6/2005 Deng
7,301,321 B1 * 11/2007 Uang et al. ..... 323/313
7,495,505 B2 * 2/2009 Chang et al. ..... 327/539
7,965,129 B1 * 6/2011 Wadhwa et al. ..... 327/513

OTHER PUBLICATIONS

Alain Fabre, et al., Transaction Briefs, "Two New Temperature Compensated Current Sources", IEEE Transactions on Circuits and Systems—I: Fundamental Theory and Applications, vol. 44, No. 11, Nov. 1997, pp. 1071-1074.

Willy M. Sansen, et al., "A CMOS Temperature-Compensated Current Reference", IEEE Journal of Solid-State Circuits, vol. 23, No. 3, Jun. 1988, pp. 821-824.

* cited by examiner

*Primary Examiner* — Patrick O'Neill

(74) *Attorney, Agent, or Firm* — Alan A. R. Cooper; Wade J. Brady, III; Frederick J. Telecky, Jr.

(57) ABSTRACT

A temperature compensated current source forms an uncompensated source current that is proportional to a reference voltage applied to an impedance, wherein the impedance varies with temperature. A temperature compensation current is formed that is proportional to absolute temperature (IPTAT). The uncompensated source current and the temperature compensation current is combined to form a temperature compensated source current and provided as an output of the current source.

18 Claims, 6 Drawing Sheets

TEMPERATURE COMPENSATED CURRENT SOURCE

CLAIM OF PRIORITY UNDER 35 U.S.C. 119(a)

The present application claims priority to and incorporates by reference European Patent Application number, EP 10290378.8 (attorney docket TI-69148 EP-PS) filed Jul. 8, 2010, entitled "Temperature Compensated Current Source."

FIELD OF THE INVENTION

This invention generally relates to semiconductor devices, and in particular devices and circuits for providing a constant value current source with temperature compensation.

BACKGROUND OF THE INVENTION

In integrated circuit (IC) chip design, components and circuitry formed therein are typically operated using a variety of signals, including reference signals. Certain components operate based on voltage signals, while other components are designed to function based on current signals. As the complexity of integrated circuits continues to increase, the accuracy of such voltage and current reference signals becomes increasing important. One problem that typically affects the accuracy of current signals in IC chips is the impact temperature has on components used to generate the current signals. Since avoiding temperature fluctuations altogether is typically not possible, steps must be taken to minimize the effects of temperature fluctuation among the circuitry used to generate the current signals.

Various known solutions use circuit topologies in which two or more resistive elements are arranged with a configuration of semiconductors so that drift caused by temperature change of one resistor is balanced by temperature change in another resistor.

Providing a stable current source without using temperature compensation may be performed in an integrated circuit (IC) solution with either the usage of one or more external low-temperature coefficient (TC) resistors, which require an extra pin(s) on the IC, or dedicated technology layers within the IC to integrate zero temperature coefficient (ZTC) resistors within the IC. These layers are usually optional when available and then they have an additional cost.

BRIEF DESCRIPTION OF THE DRAWINGS

Particular embodiments in accordance with the invention will now be described, by way of example only, and with reference to the accompanying drawings.

DETAILED DESCRIPTION OF EMBODIMENTS OF THE INVENTION

An embodiment of the present invention provides a temperature compensated current source using an impedance based reference current and a compensation current that is proportional to absolute temperature.

Figure 1:
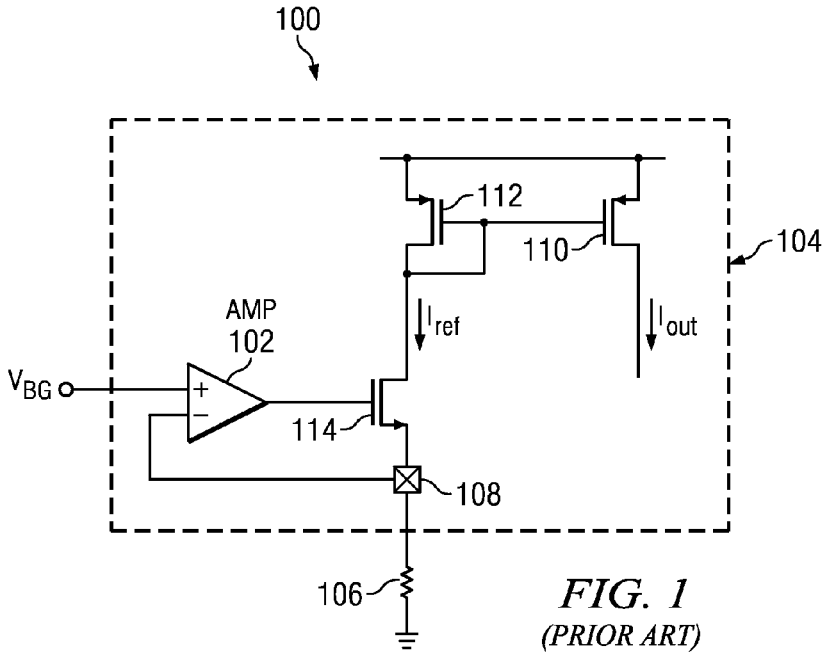
FIG. 1 (PRIOR ART)
FIG. 1 is a schematic diagram of a prior art current source.

In order to better understand the principles disclosed herein, a conventional current source will be described briefly. FIG. 1 illustrates an embodiment of a conventional current source circuit 100. Circuit 100 may be used for generating an output current that may be used by various components in an integrated circuit chip, for example, as a reference signal for circuit biasing.

Current source 100 includes a differential amplifier 102 within an output current circuit 104. In addition, circuit 100 includes a resistive element 106, coupled to the output current circuit 104 via a bond pad 108. The output current circuit 104 includes first and second mirror transistors 110, 112, having their gates coupled together, and driven by a third transistor 114. The third transistor 114 has its gate coupled to the output of the amplifier 102 to be driven as needed. A band-gap voltage $V_{BG}$ is input to the amplifier 102, along with a signal taken from the bond pad 108, and the result is used to drive the third transistor 114.

In function, a reference current $I_{REF}$ is regulated by the resistance of the resistive element 106, and is also used as a negative input signal to the amplifier 102. The amplifier 102 compares the voltage across the resistive element 106 created by the reference current $I_{REF}$ and the band-gap voltage $V_{BG}$ and outputs a signal that adjusts the third transistor 114. As the reference current $I_{REF}$ is adjusted, an output current $I_{OUT}$, which is a mirror of the reference current $I_{REF}$, is generated using the first and second transistors 110, 112 and is output from the output current circuit 104 for use by other appropriate components in the chip as a current biasing signal.

The bond pad 108 is employed since the resistive element 106 is located off-chip, as is often seen in conventional circuit design. By employing an off-chip resistive element, the output current $I_{OUT}$ generated by the output current circuit 104 is less affected by any temperature fluctuation on the chip or within the resistive element 106 itself, whose temperature coefficient is negligible in most embodiments. Specifically, by being located off-chip, the resistive element 106 may be a large temperature independent resistor or resistor array, or even an active load. Although usually successful in avoiding temperature-based deficiencies, off-chip resistive elements are typically more expensive to manufacture and add steps to the manufacturing process. In addition, overall device size may be increased when employing off-chip designs.

In an alternative conventional design, the resistive element 106 may be located on-chip, typically in the form of a semiconductor resistor array. However, process variations, as well as other causes, usually result in semiconductor resistors whose operation is impacted by their own temperature shifts. Specifically, such temperature shifts in on-chip resistors typically impact the output current $I_{OUT}$ generated by the circuit 100. In many cases, as the temperature of the resistive element 106 increases, the output current $I_{OUT}$ decreases due to constricted current flow there-through. Of course, fluctuations in the output current signal $I_{OUT}$, which is used by other components as a biasing signal, can severely impact the operation of those other components, often to the detriment of the entire chip.

Linear temperature coefficients of standard poly resistors are in the range of hundreds of ppm/deg C. and can drive large variations of a current in temperature when used in a standard reference voltage to current (V-to-I) converter. As an example, an exemplary standard on-chip V-to-I current generator with bandgap input voltage reference and using a high poly resistor may suffer a 280 ppm/° C. (typical) spread in temperature, just considering the spread of the resistor without including the variation in temperature of the bandgap reference. This means a variation of more than 4.5% in the range [−40; +125° C.], which is a typical operation range an integrated circuit (IC) for use a mobile handset for cellular telephone networks. Such a wide variation is typically not acceptable.

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
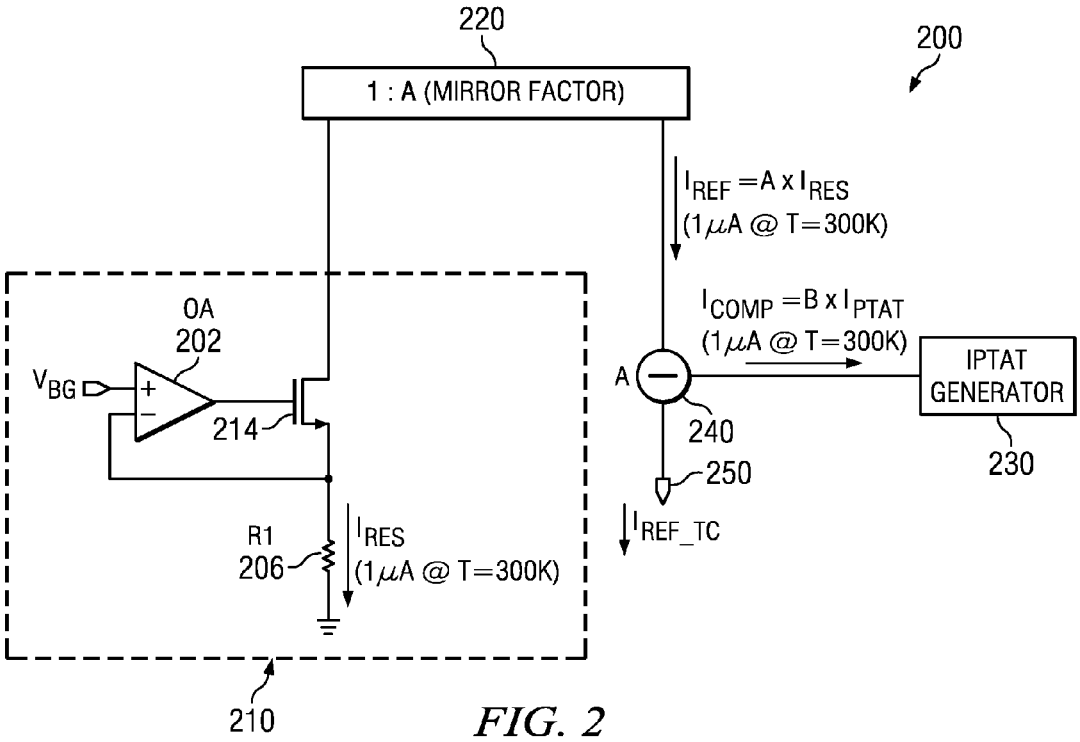
FIG. 2 is a block diagram of a temperature compensated current source.

FIG. 2 is a block diagram of a temperature compensated current source 200 that embodies an aspect of the current invention. In a typical mobile handset that includes current source 200, a maximum spread of ±3% of the output current is allowed. This spread includes mismatches (current mirrors, offset of the operational amplifier, etc), technology spread (in the range of ±9-10%) and temperature variation in the entire operating range [−40; +125° C.].

Current source 200 includes a resistor-based current generator component 210 that includes a differential amplifier 202, reference current transistor 214, and reference resistor 206 that operate to form reference current $I_{REF}$ in response to band gap reference voltage $V_{BG}$ in a similar manner as described for current source 100. Technology spread, systematic offset and mismatches can be mitigated by trimming reference resistor 206 using known trimming techniques. For example, 4-bit trimming may allow reducing a typical technology spread down to ±0.5%. However, temperature variations cannot be managed by trimming.

Rather than using expensive zero temperature coefficient resistors, embodiments of the invention use two different and independent circuits to compensate the source: the first one is a classical resistor-based current generator (which can use trimming); the second one is a current proportional to absolute temperature (IPTAT) generator. The two current contributions are then combined to get a temperature compensated current source. The temperature compensation can be also easily disabled, thus coming back to a standard non-compensated approach. Disabling the temperature compensation circuit may be used to reduce current during a low power mode of operation, for example.

This solution is "low-cost" since it requires just an additional IPTAT source to compensate a standard current generator. Since IPTAT generators are usually present in a typical mixed-signal device with medium complexity, the temperature compensation can be achieved at no additional cost when using this technique.

The two current components must be combined together taking into account the temperature coefficients of the two different sources in order to minimize the temperature spread in the whole temperature range. The calculations described herein relate to a 0.35 μm integrated circuit (IC) process technology used by Texas Instruments known as LBC7 technology; however, the concepts described herein may be easily extended other IC process technologies.

For the sake of the description, assume that a temperature-compensated 15 uA reference current ($I_{IREF_TC}$) is needed. The first current component, $I_{REF}$ is the standard resistor-based current reference from generator 210 that is formed in mirror circuit 220 as a multiple of the reference resistor current, $I_{RES}$, where "A" is the mirror factor.

$$I_{REF}=A\times I_{RES}$$

The second current component is from IPTAT source 230, which is used to temperature compensate the final reference current. Compensation current $I_{comp}$ formed in a mirror circuit as a multiple of the IPTAT current, where "B" is the mirror factor.

$$I_{COMP}=B\times I_{PTAT}$$

For the sake of simplicity, it is assumed that both $I_{RES}$ and $I_{PTAT}$ are 1 uA references in this embodiment. Hence, by using Kirchhoff's law at node 240, $I_{REF_TC}$ can be represented as shown in equation (1).

$$I_{REF_TC}=A\times I_{RES}-B\times IPTAT \quad [1]$$

In order to configure the mirror circuits, coefficients A and B need to be calculated, which optimize the temperature compensation of $I_{REF_TC}$. A and B coefficients can be calculated by solving the following two-equation system:

$$\begin{cases} I_{REF_TC} = A\times I_{RES_1U} - B\times IPTAT & [1] \\ A\times 280\text{Exp}-06 = B\times 3.33\text{Exp}-03 & [2] \end{cases}$$

Where equation (1) is the Kirchhoff-law at node 240 and equation (2) equates the slopes of the two sources vs. temperature. Equation (2) is based on the temperature coefficients of each of two current generators, 210 and 230. Note that equation 2 is obtained by equating the derivatives of the two relationships, as shown in equations (3) and (4).

$$B\times IPTAT(T) = B\times\frac{1uA}{300\text{ K}}T \quad [3]$$

$$A\times I_{RES} = A\times 1uA\times 280e-06(T-300\text{ K}) \quad [4]$$

Equations 1 and 2 can be simplified as follows, for $I_{REF_TC}$=15 uA:

$$\begin{cases} A-B=15 \\ A=12\times B \end{cases}$$

Solving the system, we get:

$$\begin{cases} A=16.36 \\ B=1.36 \end{cases}$$

These are the optimal coefficients of the mirrors to get the optimal temperature compensation for the particular IC process used in this embodiment. In the implementation of the exemplary circuit 200, A and B have been set respectively to 16 and 1 for implementation simplicity.

The previous relationships can be extended to various technologies and reference current values by using the general formula reported below:

$$\begin{cases} A = \dfrac{|k_{TC}| \times I_{REF_TC}}{(3.3\exp(-3) - |k_{TC}|)} \\ B = \dfrac{3.3\exp(-3) \times I_{REF_TC}}{(3.3\exp(-3) - |k_{TC}|)} \end{cases}$$

where $I_{REF_TC}$ is the desired reference current, $k_{TC}$ is the linear temperature coefficient (TC) of resistor 206 employed in the V-to-I converter (technology dependent).

In the previous calculations, TC $k_{TC}$ was treated as a negative coefficient, which is not true for all embodiments. In case this coefficient is positive, the IPTAT current must be added at node 240 to the current provided by the V-to-I converter, rather than being subtracted.

In other embodiments, different values may be used for the reference current ($I_{REF_TC}$), and the two component currents $I_{RES}$ and IPTAT, in which case mirror coefficients A and B are adjusted accordingly.

Figure 3:
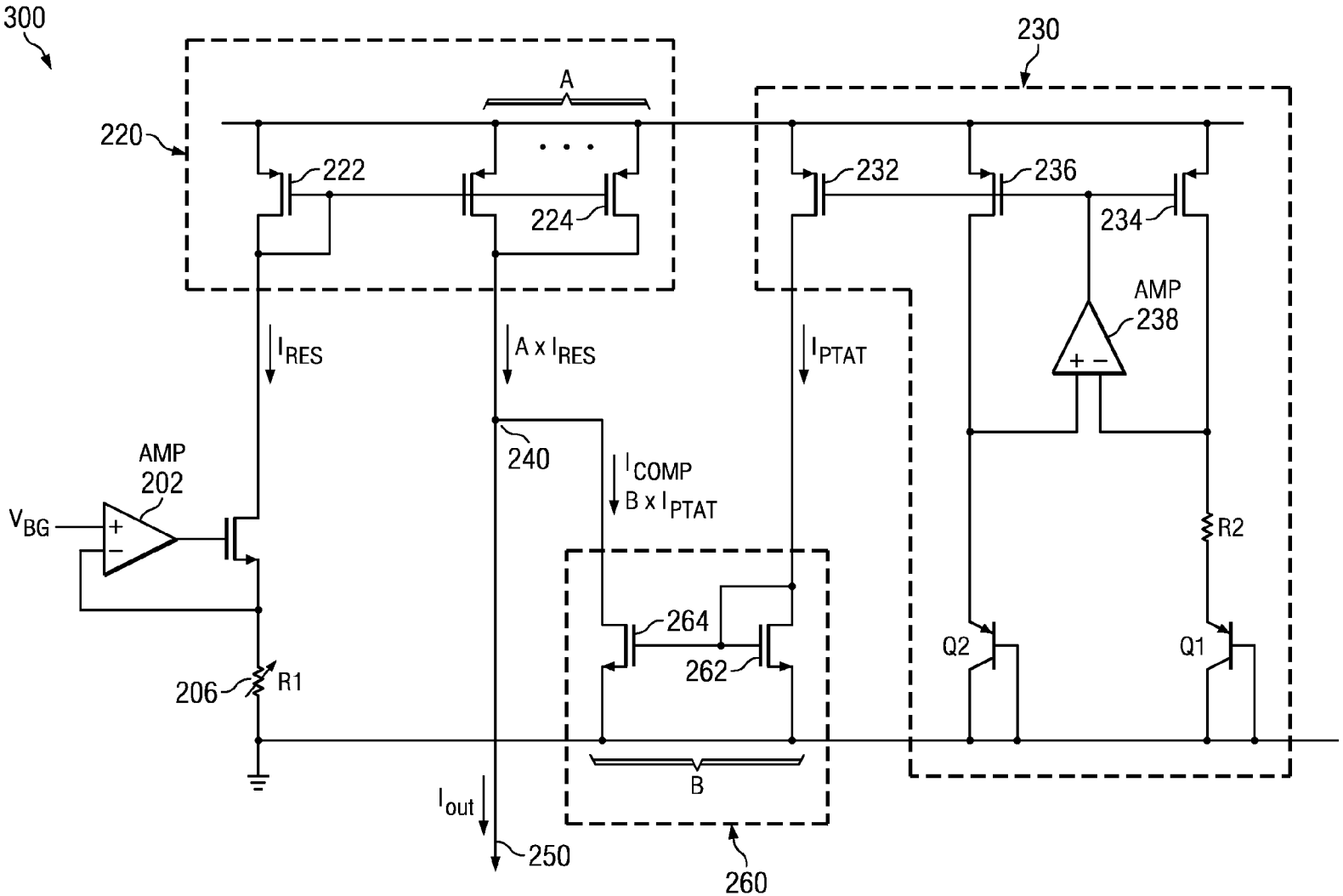
FIGS. 3 and 4 are schematics of various embodiments of the current source of FIG. 2.

FIG. 3 is a schematic of current source 300 which is an embodiment of the current source of FIG. 2. Mirror circuit 220 includes reference transistor 222 that conducts resistor current $I_{RES}$. A set of mirror transistors 224 are each coupled to reference transistor 222 as shown and therefore each conduct an identical mirror value of $I_{RES}$. As discussed above, if mirror coefficient A is selected to be sixteen, then sixteen mirror transistors are included in set 224. Similarly, IPTAT mirror 260 includes reference transistor 262 that conducts IPTAT and mirror transistor 264 that conducts an identical mirror value of IPTAT. As discussed above, if mirror value B is selected to be one, then there is only one mirror transistor 264 included in mirror 260.

To generate the current proportional to absolute temperature, Iptat, IPTAT circuitry 230 includes two bipolar junction transistors Q1, Q2. While transistors Q1, Q2 are illustrated as bipolar junction transistors (BJTs), and the rest of the transistors in the circuit 300 as field-effect transistors (FETs), any appropriate type of transistor or other active device may be incorporated without limitation. As illustrated, the bases and collectors of transistors Q1, Q2 are both coupled together to ground. However, the emitters of transistors Q1, Q2 are coupled to respective inputs of differential amplifier 238, with the emitter of transistor Q1 coupled via resistive element R2. In addition, the emitters of transistors Q1 (via resistive element R2), Q2 are directly coupled to the drains of transistors 234, 236. The gates of transistors 234, 236 are coupled together to the output of amplifier 238 and to the gate of mirror transistor 232, while the sources of transistors 234, 236 are coupled to the source of mirror transistor 232.

To implement circuit 230, a temperature coefficient associated with transistors Q1, Q2 should be considered. In an exemplary embodiment, transistor Q1 would have about eight times larger emitter area than transistor Q2, but this precise ratio is not required. Thus, Q1 has eight times smaller collector current density, which is defined as the collector area divided by the emitter area. This is to provide transistors having significantly different sizes such that their base-to-emitter voltage VBE1 and VBE2 does not change equally relative to any temperature changes. Specifically, a VBE2 minus VBE1 delta voltage V-DELTA is proportional to absolute temperature. This proportionality is quite accurate and holds even when the collector currents are temperature dependent, as long as their density ratio remains fixed. Therefore, as temperature increases, a VBE2 minus VBE1 delta voltage V-DELTA, which is equal to the voltage across the resistive element R2, is established.

With the emitters of transistors Q1, Q2 coupled to resistive element R2 and transistor 236, respectively, as well as to the inputs of amplifier 238, an amplification is provided such that the voltage across the resistive element R2 is equal to the voltage differential V-DELTA, which is relative to the temperature variations of transistor Q1, Q2. As a result, the current through the resistive element R2, as well as the current carried through transistors 232, 236, and 234, is established by the changing temperatures of transistors Q1, Q2, as well as the corresponding size difference between the two. The amplifier 238 will continue to drive current through transistors 234, 236, and thus necessarily through the mirror transistor 232, through a continued effort to equalize the voltage differential of the positive terminal voltage and negative terminal voltage.

Thus, the amplifier 238 will continue to drive whatever current is necessary through transistor 234 in order to make the negative terminal voltage of the amplifier 238 the same as its positive terminal voltage. That current will, in turn, necessarily be drawn through transistor 236 (e.g., the gates are tied together and both are the same size), and then be mirrored through mirror transistor 232.

In an exemplary embodiment, transistors 234 and 236 are substantially equal, but this is not always required. However, when they are substantially equal, if the gates and sources of the transistors 234, 236 are coupled together, as their gates are biased properly each transistor 234, 236 draws essentially the same current. Also in such embodiments, the mirror transistor 232 need not be equal to transistors 234, 236, and its value will typically vary depending on the amount of current draw desired there-through. More specifically, this value will vary based in part on the design needs of the circuit 230, as well as the amount of compensation needed and the amount of output current Iout to be provided.

In one embodiment, the circuit components used to form the IPTAT circuitry 230, and perhaps even the mirror circuit 260, already exists in the same IC chip already housing the rest of circuit 300. More specifically, process steps may simply be modified to couple components already slated to be formed in the chip, in order to create various components of the temperature compensation circuitry 230. In such an embodiment, any expense associated with constructing all new components for any of the circuitry 230 is reduced or eliminated, since existing components are employed and merely coupled in a different manner. In a more specific embodiment, components within the circuitry used to generate the band-gap voltage VBG may be employed as some or all of the components of the temperature compensation circuitry 230, but other embodiments are not so limited.

Figure 4:
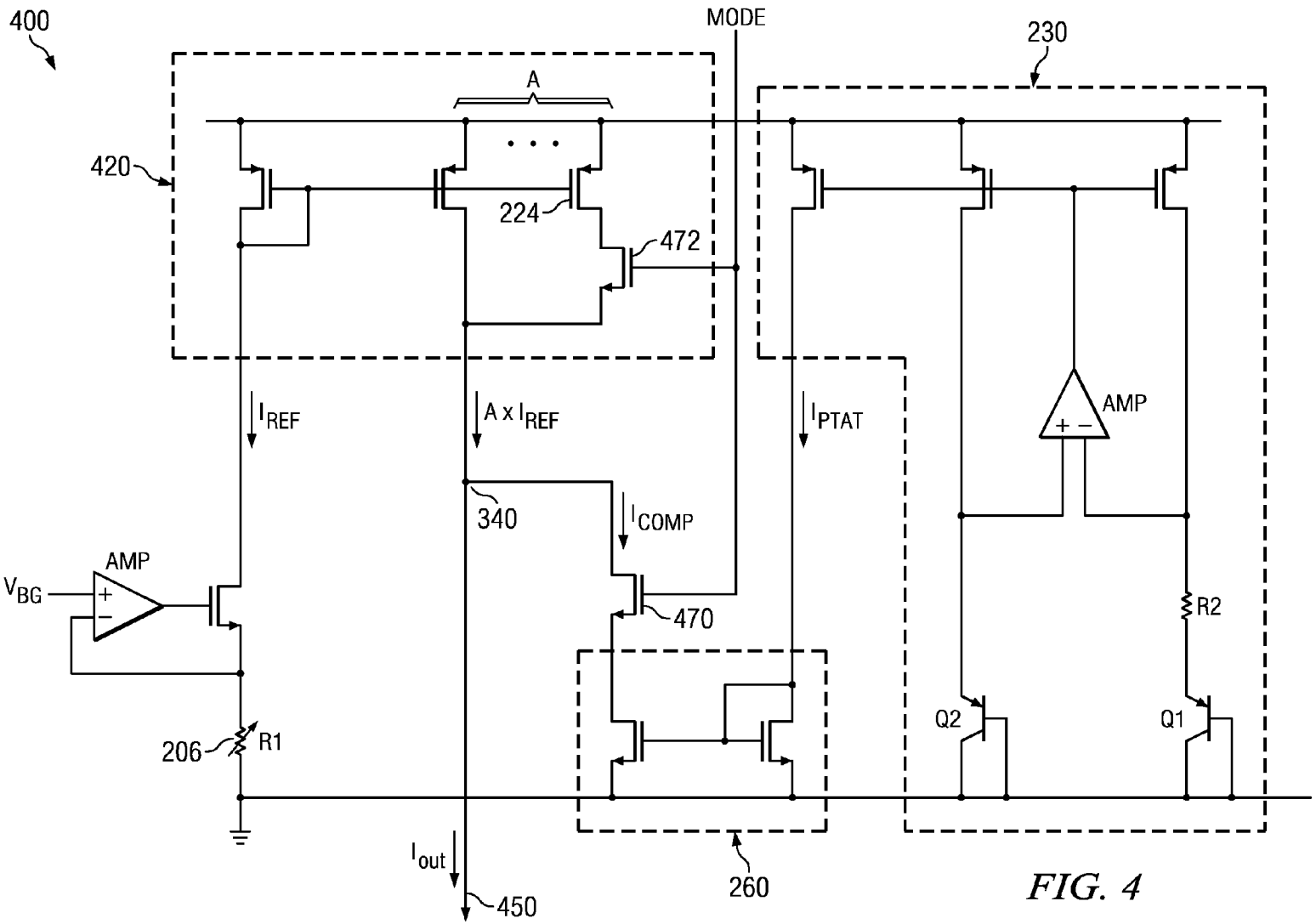

FIG. 4 is a schematic of current source 400 which is another embodiment of the current source of FIG. 2. In this embodiment, a provision is made to inhibit the compensation current $I_{COMP}$ provided by IPTAT mirror 260. This may be useful, for example, for a low power mode of operation in which the system that includes current source 400 is not performing its normal function and an accurate reference current is not required.

A mode signal is coupled to switching elements 470 and 472. In a normal mode, both switching elements are conductive and current source 400 operates as described above. In an uncompensated mode, both switching elements are turned off and compensation current $I_{COMP}$ is inhibited.

Mirror factor A may be changed during the uncompensated mode of operation to compensate for disabling the temperature coefficient current. In this manner, the output of the current source during an uncompensated mode of operation is not compensated by the temperature compensation current but remains approximately the same as during a compensated mode of operation. Changing mirror factor A is accomplished by turning off one or more of the mirror transistors in mirror set 224. For example, switching element 472 is illustrated as being able to turn off one mirror transistor in response to the mode signal. In another embodiment, there may be multiple switching elements 472 configured to turn off multiple mirror transistors.

In an embodiment in which node 340 is an additive node, then switching element(s) 472 may be configured instead to turn on in a non-compensated mode of operation to compensate for inhibiting the temperature compensation current.

In another embodiment, mirror 420 is not adjusted when the temperature compensation current is inhibited. In such an embodiment, the output current from output node 450 would have a different value during a non-compensated mode of operation in response to the compensation current being inhibited.

Figure 5:
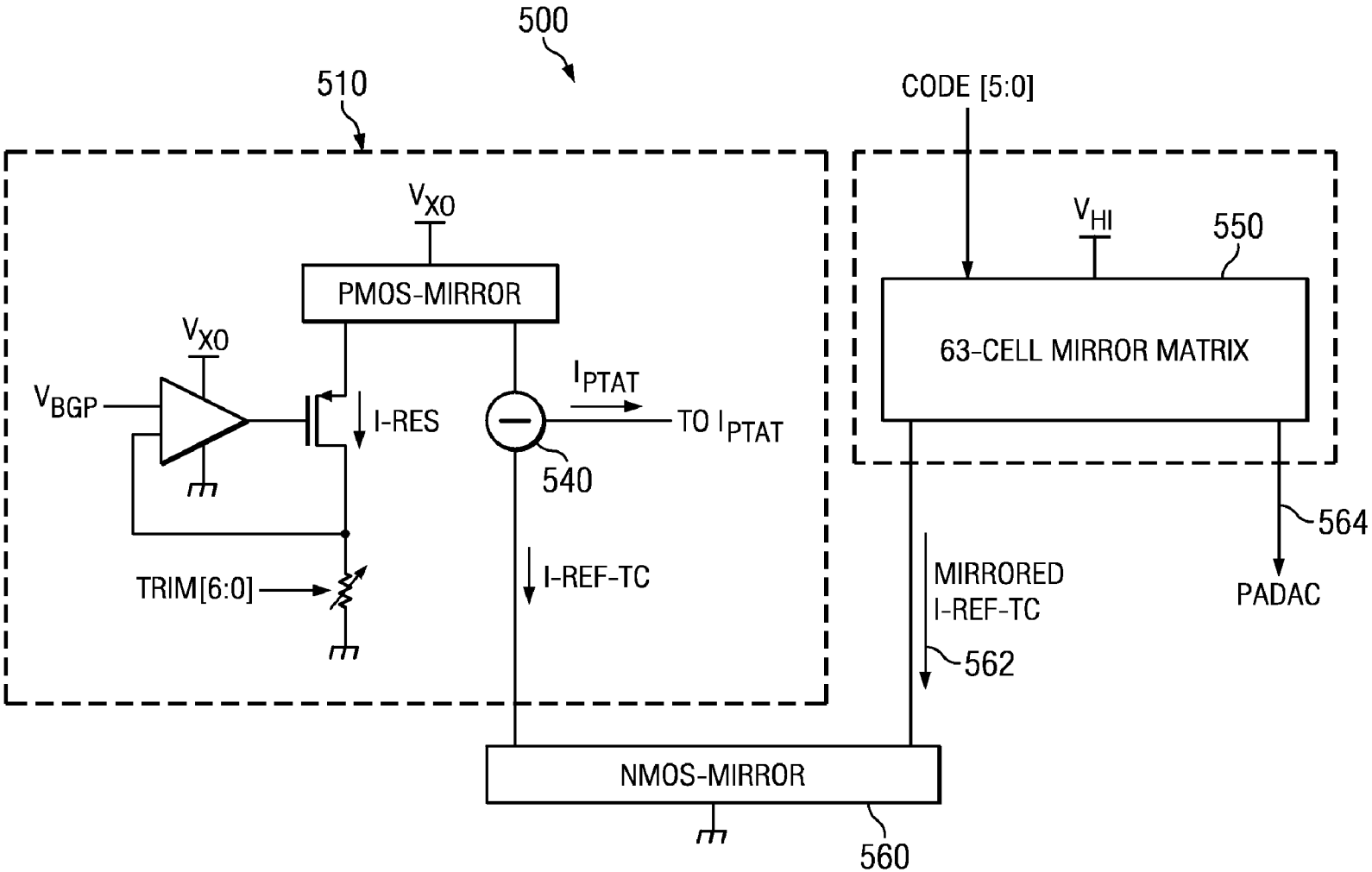
FIG. 5 is a block diagram of a digital to analog converter that includes the temperature compensated current source.

FIG. 5 is a block diagram of a parallel digital to analog converter (PADAC) 500 that includes temperature compensated current source 510, which in various embodiments operates as described with respect to FIGS. 2-4. Converter 500 includes a sixty-three cell matrix 550 of current mirrors that receives a six bit code [5:0] that specifies each digital sample value. A mirrored copy 562 of the temperature compensated mirror current I-REF-TC is provided to mirror matrix 550 by NMOS mirror 560. In response to each digital sample code, a respective number of the 63 mirrors are enabled to conduct a mirrored copy of the temperature compensated reference current 562 received from NMOS mirror 560. Thus, each of the 63 current mirrors in matrix 550 is a unit value digital to analog converter each having an output coupled to a summing node. The resulting current flows through all of the enabled mirror cells are summed and provided as the output 564 of the PADAC for each digital sample value. For example, in one embodiment, when a digital code of "000000" is received, no mirrors are enabled and the output current is therefore "0". When a digital code of "111111" is received, all 63 mirrors are enabled and the output current is therefore 63 times reference current 562. Additional filtering may then be performed on the output current 564. The general operation of converters is well known and does not need to be further described herein. In some embodiments, some or all of the mirror cells may each have a mirror factor that is different than one, in which case the dynamic range of the converter may extended. Since the output from the mirror matrix 550 is directly proportional to the reference current, a more accurate output is generated over a wide range of operating temperature when the reference current is temperature compensated, as was described in more detail above.

In some embodiments of PADAC 500, temperature compensated current source 510 may include circuitry to disable the temperature compensation as described with regard to FIG. 4. Total current is reduced while in this uncompensated mode of operation, but accuracy will be reduced over the temperature range.

Simulations Results

The overall current spread in temperature has been measured on the output current of the 6-bit DAC 500 for different supply voltages (VBAT=2.65V, 3.6V, 4.7V). The reported output current is at maximum output, output current, code="111111." Table 1 summarizes the results.

TABLE 1

| simulated output current, input = "111111" | | |
|---|---|---|
| VBAT = 3.6 V, (nominal supply voltage) temperature range: [−15; 85 deg], (other parameters are nominal) | Output currents: | 2.336 mA @ −15 deg<br>2.350 mA @ 27 deg<br>2.342 mA @ 85 deg |
| VBAT = 2.65 V, temperature range: [−15; 85 deg], (other parameters are nominal) | Output currents: | 2.336 mA @ −15 deg<br>2.350 mA @ 27 deg<br>2.342 mA @ 85 deg |
| VBAT = 4.7 V, temperature range: [−15; 85 deg], (other parameters are nominal) | Output currents: | 2.336 mA @ −15 deg<br>2.350 mA @ 27 deg<br>2.342 mA @ 85 deg |

Table 1 demonstrates that the temperature compensation described herein provides a 0.6% accuracy in this embodiment over temperature and over the whole battery range [2.65V-4.7V]. Another simulation predicted the use of a ZTCR based current source would give an accuracy of about 0.2% (nominal case).

Figure 6:
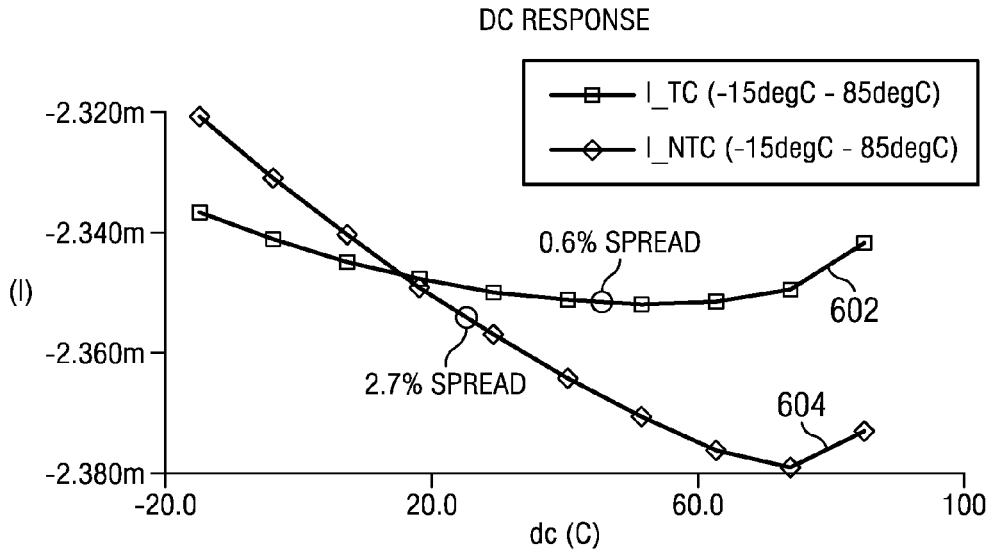
FIG. 6 is plot illustrating operation of the temperature compensated current source over a range of temperatures.

FIG. 6 is plot illustrating operation of DAC 500 with the temperature compensated current source over a range of temperature from −15 to 85C and shows a comparison between the temperature compensated output current (I_TC) and the current provided by the DAC when the temperature compensation is disabled (I_NTC). Plot line 602 illustrates operation with temperature compensation enabled, which produces a spread of only 0.6%. Plot line 604 illustrates operation with temperature compensation disabled using the mode signal of current source 400, in which a spread of 2.7% occurs over the temperature range. Without temperature compensation accuracy would be in the order of 4.5% over the whole temperature range [−40 deg C.; 125 deg C.].

Figure 7:
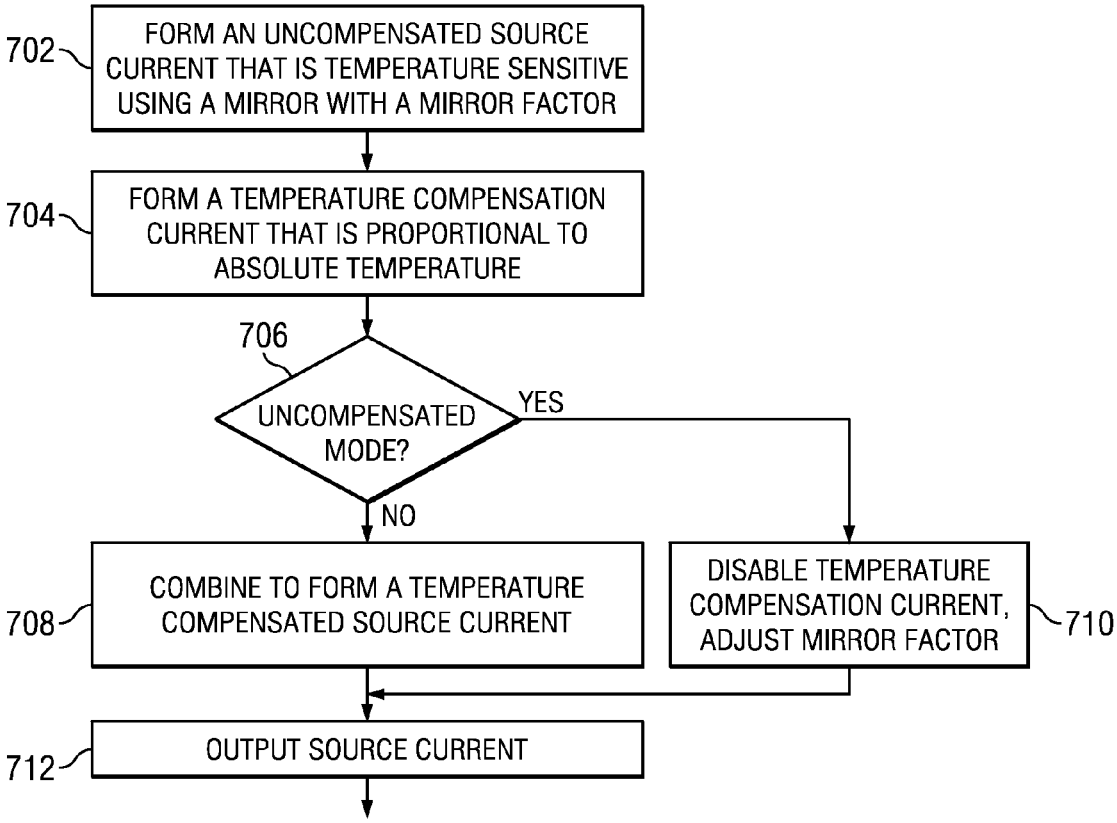
FIG. 7 is a flow diagram illustrating operation of the temperature compensated current source.

FIG. 7 is a flow diagram illustrating operation of the temperature compensated current source. An uncompensated source current is formed 702 that is proportional to a reference voltage applied to an impedance device; however, unfortunately the impedance of impedance device may vary with temperature and cause variation of the source current. A temperature compensation current is formed 704 that is proportional to absolute temperature (IPTAT), as described in more detail above. The uncompensated source current and the temperature compensation current are combined 708 to form a compensated source current that is provided 712 as an output of the current source.

In some embodiments, an uncompensated mode of operation may be supported. In this case, when the compensated mode of operation is selected 706, then the current source operates as described above. However, when the uncompensated mode of operation is selected 706, then formation of the temperature compensation current is disabled 710 during the uncompensated mode of operation. In this case, the output of the current source is not compensated by the temperature compensation current.

In some embodiments, forming 702 the uncompensated source current is done by generating a reference current by applying the reference voltage to the impedance device and then forming a mirror copy of the reference current that has a mirror factor A to be the uncompensated source current.

In some embodiments, forming 704 the temperature compensation current is done by generating an IPTAT reference current that is directly proportional to absolute temperature, and then forming a mirror copy having a mirror coefficient B of the IPTAT reference current to be the temperature compensation current.

System Example

Figure 8:
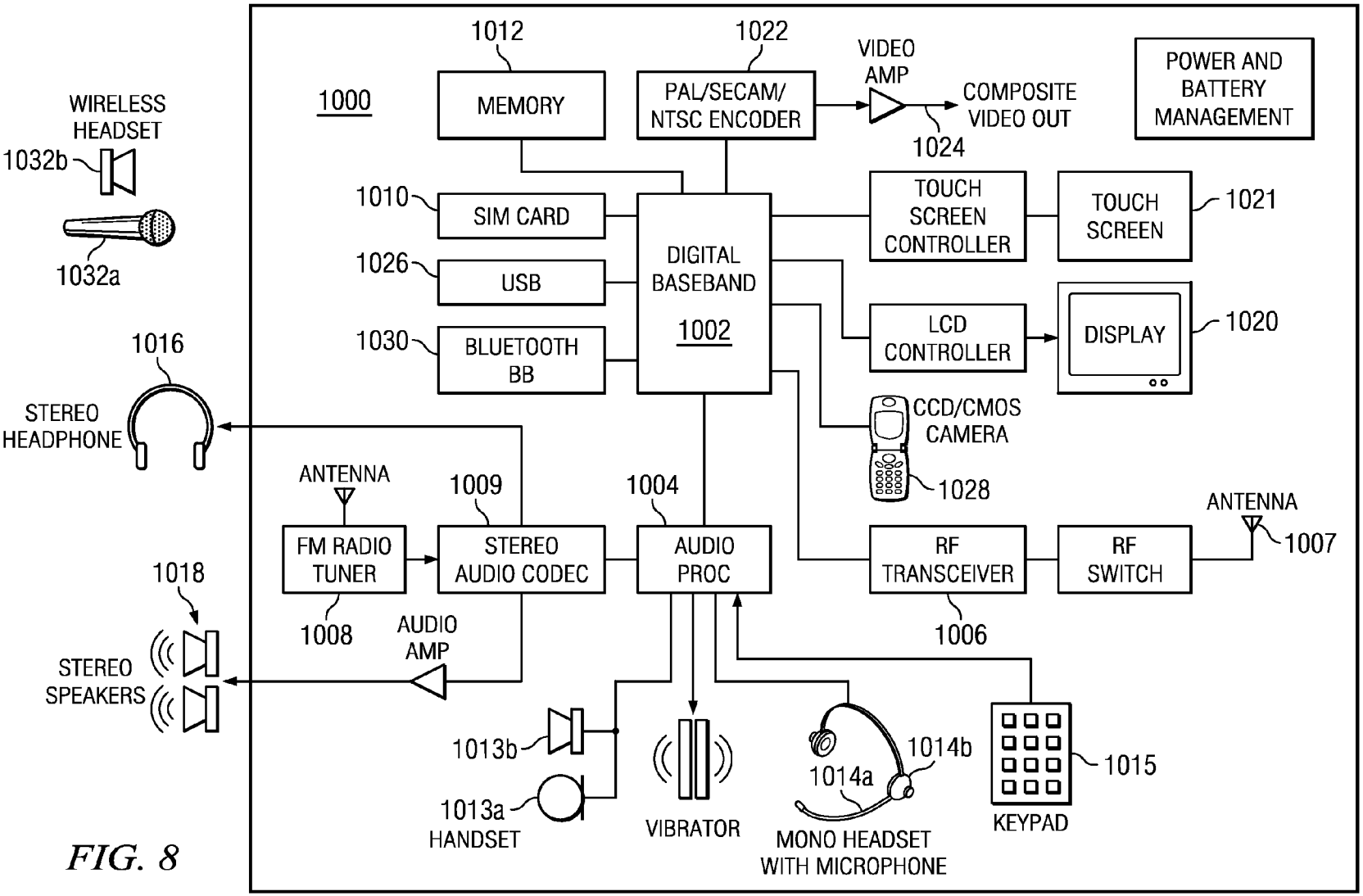
FIG. 8 is a block diagram of a mobile device that includes the temperature compensated current source.

FIG. 8 is a block diagram of an exemplary mobile cellular phone 1000 that includes an embodiment of the present invention. Digital baseband (DBB) unit 1002 may include a digital processing processor system (DSP) that includes embedded memory and security features. Audio Processing (AP) unit 1004 receives a voice data stream from handset microphone 1013*a* and sends a voice data stream to handset mono speaker 1013*b*. AP unit 1004 also receives a voice data stream from microphone 1014*a* and sends a voice data stream to mono headset 1014*b*. Usually, AP and DBB are separate ICs. In most embodiments, AP does not embed a programmable processor core, but performs processing based on configuration of audio paths, filters, gains, etc being setup by software running on the DBB. In an alternate embodiment, AP processing is performed on the same processor that performs DBB processing. In another embodiment, a separate DSP or other type of processor performs AP processing.

AP unit 1004 includes an analog to digital converter for converting an audio analog signal from microphones 1014*a* and 1013*a* to a digital signal that is then processed by DBB unit 1002 for transmission via RF transceiver 1006. AP unit 1004 also includes a digital to analog converter for converting digital data received via RF transceiver 1006 into an audio analog signal for use by speaker 1013*b* or headset 1014*b*. The digital to analog converter may contain a temperature compensated current source that is embodied as described in more detail with respect to FIGS. 2-7.

RF transceiver 1006 is a digital radio processor and includes a receiver for receiving a stream of coded data frames from a cellular base station via antenna 1007 and a transmitter for transmitting a stream of coded data frames to the cellular base station via antenna 1007. RF transceiver 1006 is coupled to DBB 1002 which provides processing of the frames of encoded data being received and transmitted by cell phone 1000.

DBB unit 1002 may send or receive data to various devices connected to universal serial bus (USB) port 1026. DBB 1002 can be connected to subscriber identity module (SIM) card 1010 and stores and retrieves information used for making calls via the cellular system. DBB 1002 can also connected to memory 1012 that augments the onboard memory and is used for various processing needs. DBB 1002 can be connected to Bluetooth baseband unit 1030 for wireless connection to a microphone 1032*a* and headset 1032*b* for sending and receiving voice data. DBB 1002 can also be connected to display 1020 and can send information to it for interaction with a user of the mobile UE 1000 during a call process. Touch screen 1021 may be connected to DBB 1002 for haptic feedback. Display 1020 may also display pictures received from the network, from a local camera 1028, or from other sources such as USB 1026. DBB 1002 may also send a video stream to display 1020 that is received from various sources such as the cellular network via RF transceiver 1006 or camera 1028. DBB 1002 may also send a video stream to an external video display unit via encoder 1022 over composite output terminal 1024. Encoder unit 1022 can provide encoding according to PAL/SECAM/NTSC video standards. In some embodiments, audio codec 1009 receives an audio stream from FM Radio tuner 1008 and sends an audio stream to stereo headset 1016 and/or stereo speakers 1018. In other embodiments, there may be other sources of an audio stream, such a compact disc (CD) player, a solid state memory module, etc.

Other Embodiments

While embodiments of the invention are useful for battery powered mobile devices, other embodiments may be wall powered personal computers, servers or whole racks of processors. Various embodiments may represent any of a variety of devices such as a server, a desktop computer, a laptop computer, a cellular phone, a Personal Digital Assistant (PDA), a smart phone or other electronic devices.

While a particular embodiment of an IPTAT generator was described, many configurations of IPTAT generators are known and used and any one of these may be included in an embodiment of the invention to provide compensation current. Similarly, various configurations of V to I generators may be used for forming the uncompensated source current. While a resistor was described, other types of impedance devices may be used for establishing a reference current.

While a six-bit PADAC was described, other embodiments of converters may have more or fewer bits of resolution, or use other methods of conversion than a matrix of current mirrors, such as sigma-delta converters, etc.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A method for providing a current source, comprising:

forming an uncompensated source current that is proportional to a reference voltage applied to an impedance, wherein the impedance varies with temperature;

forming a temperature compensation current that is proportional to absolute temperature (IPTAT);

combining the uncompensated source current and the temperature compensation current to form a temperature compensated source current;

providing the temperature compensated source current as an output of the current source, and disabling formation of the temperature compensation current during an uncompensated mode of operation, whereby during the uncompensated mode the output of the current source is not compensated by the temperature compensation current.

2. The method of claim 1, wherein forming the uncompensated source current comprises:

generating a reference current by applying the reference voltage to the impedance; and forming a mirror copy of the reference current having a mirror factor A to form the uncompensated source current.

3. The method of claim 2, wherein forming the temperature compensation current comprises:

generating an IPTAT reference current that is directly proportional to absolute temperature; and forming a mirror copy having a mirror factor B of the IPTAT reference current to form the temperature compensation current.

4. The method of claim 3, further comprising selecting a value for mirror factor A and for mirror factor B that a derivative of the uncompensated source current and a derivative of the temperature compensation current are approximately equal.

5. The method of claim 4, wherein the mirror factor A and the mirror factor B are selected to have a ratio of approximately 16:1.

6. The method of claim 2, further comprising:

changing mirror factor A during the uncompensated mode of operation to compensate for disabling the temperature coefficient current, whereby the output of the current source during the uncompensated mode of operation is not compensated by the temperature compensation current but remains approximately the same as during a compensated mode of operation.

7. The method of claim 1, wherein combining the uncompensated source current and the temperature compensation current is performed by direct summation of the uncompensated source current and the temperature compensation current.

8. The method of claim 1, wherein combining the uncompensated source current and the temperature compensation current is performed by direct subtraction of the temperature compensation current from the uncompensated source current.

9. A system comprising a temperature compensated current source, wherein the temperature compensated current source comprises:

an uncompensated source current generator that is operable to form an uncompensated reference current proportional to a reference voltage applied to an impedance, wherein the impedance varies with temperature;

a temperature compensation current generator that is operable to form a temperature compensation current that is proportional to absolute temperature (IPTAT);

a combining node coupled to receive the uncompensated reference current and the temperature compensation current and operable to form a temperature compensated source current; and an output coupled to the combining node for providing the temperature compensated source current as an output of the current source, wherein the uncompensated source current generator comprises:

a circuit for generating a reference current by applying the reference voltage to the impedance; and a mirror circuit having a mirror factor A for forming a mirror copy of the reference current to form the uncompensated reference current, a switching element coupled to the temperature compensation current generator operable to disable formation of the temperature compensation current during an uncompensated mode of operation; and another switching element coupled to the current mirror being configured to change mirror factor A during the uncompensated mode of operation to compensate for disabling the temperature compensation current, whereby the output of the current source during the uncompensated mode of operation is not compensated by the temperature compensation current but remains approximately the same as during a compensated mode of operation.

10. The current source of claim 9, wherein the temperature compensation current generator comprises:

a circuit for generating an IPTAT reference current that is directly proportional to absolute temperature; and a second mirror circuit having a mirror factor B for forming a mirror copy of the IPTAT reference current to form the temperature compensation current.

11. The current source of claim 9, further comprising a switching element coupled to the temperature compensation current generator operable to disable formation of the temperature compensation current during the uncompensated mode of operation.

12. The current source of claim 9, wherein the combining node is a summing junction.

13. The current source of claim 9, wherein the combining node is a subtraction junction.

14. The system of claim 9, further comprising a digital to analog converter comprising a plurality of digital to analog converters each having an output coupled to a summing node, wherein each of the converters is coupled to receive the temperature compensated source current from the current source.

15. The system of claim 14 being a mobile handset, wherein an output of the digital to analog converter is coupled to an audio reproduction device.

16. A system comprising a temperature compensated current source, wherein the temperature compensated current source comprises:

an uncompensated source current generator that is operable to form an uncompensated reference current proportional to a reference voltage applied to an impedance, wherein the impedance varies with temperature;

a temperature compensation current generator that is operable to form a temperature compensation current that is proportional to absolute temperature (IPTAT);

a combining node coupled to receive the uncompensated reference current and the temperature compensation current and operable to form a temperature compensated source current;

an output coupled to the combining node for providing the temperature compensated source current as an output of the current source, and a switching element coupled to the temperature compensation current generator operable to disable formation of the temperature compensation current during an uncompensated mode of operation, whereby during the uncompensated mode the output of the current source is not compensated by the temperature compensation current.

17. The current source of claim 16, wherein the combining node is a summing junction.

18. The current source of claim 16, wherein the combining node is a subtraction junction.

* * * * *